US007144193B1

(12) United States Patent
Bousfield

(10) Patent No.: US 7,144,193 B1
(45) Date of Patent: Dec. 5, 2006

(54) FINISHING TROWEL

(76) Inventor: Samuel Hall Bousfield, 1820 Hillish Rock Rd., Meadow Vista, CA (US) 95722

( * ) Notice: Subject to any disclaimer, the term of this patent is extended or adjusted under 35 U.S.C. 154(b) by 0 days.

(21) Appl. No.: 11/252,392

(22) Filed: Oct. 17, 2005

Related U.S. Application Data

(60) Provisional application No. 60/619,784, filed on Oct. 16, 2004.

(51) Int. Cl.
*B05C 17/10* (2006.01)
*E01C 19/22* (2006.01)

(52) U.S. Cl. ..... 404/97; 404/118; 15/235.4

(58) Field of Classification Search ..... 404/89, 404/93, 75, 118, 101, 97; 7/164, 163, 114; 15/235.4
See application file for complete search history.

(56) References Cited

U.S. PATENT DOCUMENTS

| | | | | |
|---|---|---|---|---|
| 747,036 | A | 12/1903 | Bishop | |
| 2,526,401 | A | 10/1950 | Oscar | |
| 3,947,916 | A | 4/1976 | Mitchell | |
| 4,080,684 | A | 3/1978 | Venditti | |
| 4,397,581 | A * | 8/1983 | Jarvis | 404/97 |
| 4,467,492 | A | 8/1984 | Harrington | |
| 4,724,572 | A * | 2/1988 | Gringer | 15/235.4 |
| 4,737,097 | A | 4/1988 | Cotugno | |
| 5,103,520 | A * | 4/1992 | Mazzo | 7/104 |
| 5,119,521 | A * | 6/1992 | Clontz | 7/164 |
| 5,231,729 | A | 8/1993 | Rose | |
| 5,450,648 | A | 9/1995 | Dovin et al. | |
| 5,479,675 | A | 1/1996 | Pytlewski | |
| 5,906,455 | A | 5/1999 | McLaughlin | |
| 6,178,586 | B1 | 1/2001 | Jafarmadar | |
| 6,205,610 | B1 | 3/2001 | Westthorp | |
| 6,415,472 | B1 * | 7/2002 | Williams | 15/235.4 |
| 6,550,214 | B1 | 4/2003 | Aguilera | |
| 6,679,652 | B1 | 1/2004 | Suriano | |
| 6,905,290 | B1 * | 6/2005 | Casciato, Jr. | 407/29.15 |
| 2006/0070186 | A1 * | 4/2006 | Karlstedt | 7/105 |

* cited by examiner

*Primary Examiner*—Raymond W Addie
(74) *Attorney, Agent, or Firm*—R. Dabney Eastham

(57) ABSTRACT

A trowel for finishing the top of concrete stem walls around protruding anchor bolts has a finishing surface in the form of a blade or block attached to a handle. An opening in the form of a notch or a hole is provided in the blade or block for accommodating an anchor bolt. The trowel may be provided with means to position the anchor bolt vertically and horizontally in addition to finishing the concrete around the anchor bolt. The trowel may also have a curved side edge for rounding the concrete where it contacts the form.

13 Claims, 11 Drawing Sheets

FINISHING TROWEL

CROSS-REFERENCE TO RELATED APPLICATIONS

This application claims the benefit of priority under 35 U.S.C. § 119(e) from my U.S. provisional application No. 60/619,784, filed on Oct. 16, 2004, which is incorporated by reference into this application as if fully set forth herein.

STATEMENT REGARDING FEDERALLY SPONSORED RESEARCH OR DEVELOPMENT

Not applicable.

FIELD OF THE INVENTION

The field of the invention is apparatus including a molding surface which shapes a fluent or bulk material, which material has plasticity as a property, into a self-sustaining article of desired shape.

BACKGROUND OF THE INVENTION

Structures that can withstand earthquake and wind forces require the use of anchor bolts to connect a concrete foundation to the wood or steel framing of the structure. More anchor bolts are used than in the past due to increased understanding of the effects of earthquake and wind forces on structures.

Anchor bolts are embedded in the concrete foundation so that they project perpendicularly from the foundation for connection to the framing. The bolts generally should be centered on the sill plate, or bottom plate, of the wall framing that will sit on top of the foundation walls.

Workmen typically insert the anchor bolts by hand into the wet concrete of the foundation after the concrete has been poured into forms. Alternatively, the workmen may attach bolts of larger size to reinforcing rods or the like before the concrete is poured. Workmen then use trowels to smooth and level the surface of the wet concrete in the foundation forms.

The anchor bolts embedded in the wet concrete interfere with the easy performance of the smoothing and leveling task because of the extra motions of the trowel that the workman must perform in order to smooth the concrete around the bolts. The final orientation and positioning of the anchor bolts after the completion of the smoothing and leveling task is usually done by eye.

Workers in the building trades have used trowels for nearly as long as mortar has been used. Advancements in trowel design have mainly centered around making them lighter and with ergonomic handles. Very little has been done either to make a trowel useful for smoothing mortar and concrete around anchor bolts or to assist in the orientation and positioning of anchor bolts.

A need exists for a finishing trowel designed to both reduce the number of movements needed to finish the concrete around anchor bolts and do a better job of finishing around anchor bolts. A need also exists for a finishing trowel designed to enable the trowel to be used to orient anchor bolts correctly so that the bolts are perpendicular to the concrete and protrude the correct distance from the concrete. A need further exists for a finishing trowel that has a design that will enable the trowel to be used to confirm the correct positioning of anchor bolts.

SUMMARY OF THE INVENTION

The invention is a concrete finishing tool or trowel for finishing the top of concrete stem walls and particularly making it easier to finish around anchor bolts. A trowel for finishing a plastic or fluid material, such as concrete, around a bolt embedded in the plastic material, comprises a finishing surface in the form of a blade or block with a top side and a bottom side and a plurality of edges, and a handle attached to the top side of the blade or block. The blade or block has an opening formed therein that is sized and shaped to receive the bolt embedded in and protruding from the plastic material so that at least the bottom side of the blade or block can be used to finish around the bolt.

In one version of the finishing trowel according to the invention the opening in the blade or block is a notch formed therein at one of the edges that is sized and shaped to receive the bolt embedded in and protruding from the plastic material when the blade or block of the trowel is advanced toward the bolt.

In another version of the finishing trowel according to the invention the opening in the blade or block is a hole formed therein communicating between the top and bottom sides of the blade or block. The hole is sized and shaped to receive the bolt embedded in and protruding from the plastic material when the blade or block of the trowel is placed over the bolt.

The finishing trowel according to the invention may be provided with means for centering the anchor bolts at the correct distance from the face of the stem wall, positioning the bolts perpendicular to the concrete surface, and indicating whether the bolts protrude the correct distance from the concrete surface. The blade of the finishing trowel according to the invention may also be shaped to produce a rounded edge to one side of a concrete stem wall while the concrete is in a plastic state.

OBJECTS OF THE INVENTION

It is an object and advantage of the present invention to provide a trowel to simply and easily finish concrete around protruding bolts or other small projections while the concrete is in a plastic state.

Another object and advantage is to provide a trowel with means to locate projections such as bolts at a given distance from a straight line or concrete form-work while the concrete is in a plastic state.

Another object and advantage is to provide a trowel with means for indicating the proper height for anchor bolts above a concrete surface while the concrete is in a plastic state.

Another object and advantage is to provide a trowel with a means for aligning bolts or small protrusions perpendicular to a concrete surface while the concrete is in a plastic state.

Another object and advantage is to provide a trowel having means to produce a rounded edge to one side of a concrete stem wall while the concrete is in a plastic state.

REFERENCE NUMERALS IN THE DRAWINGS

Figure 1:
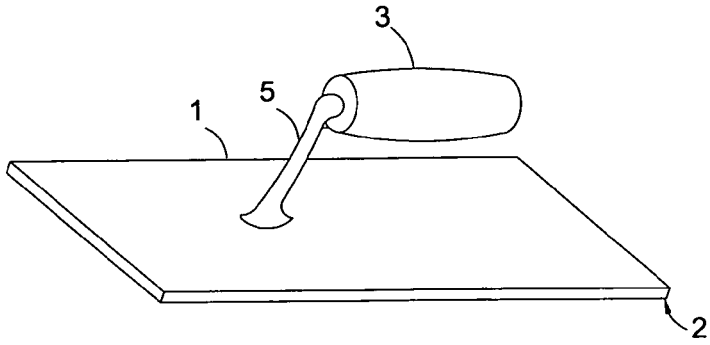
FIG. 1 is a right perspective view from above of a prior art concrete finishing trowel.

| | |
|---|---|
| 1 | blade |
| 2 | prior art finishing trowel |
| 3 | handle |
| 5 | arm |
| 8 | first preferred embodiment of the finishing trowel according to the invention |
| 7 | blade |
| 9 | notch |
| 11 | handle |
| 13 | arm |
| 14 | blade |
| 15 | exemplary notch of the finishing trowel according to the invention |
| 17 | variant of notch 15 |
| 19 | variant of notch 15 |
| 21 | variant of notch 15 |
| 23 | variant of notch 15 |
| 25 | variant of notch 15 |
| 40 | variant of first preferred embodiment of the finishing trowel according to the invention |
| 41 | blade |
| 43 | notch |
| 45 | handle |
| 47 | arm |
| 50 | second preferred embodiment of the finishing trowel according to the invention |
| 56 | height indication mark |
| 57 | handle |
| 58 | height indication mark |
| 59 | screw |
| 60 | screw |
| 62 | bracket |
| 63 | weld points |
| 66 | bolt alignment attachment |
| 67 | anchor bolt |
| 68 | blade |
| 72 | notch |
| 73 | notch |
| 74 | axis |
| 75 | edge (for contacting form where the concrete is to be rounded) |
| 76 | rounded corner |
| 77 | rounded corner |
| 78 | region of blade 68 that is curved downward |
| 80 | region of blade 68 that is curved upward |
| X | set anchor bolt height |
| Y | set anchor bolt horizontal distance |
| 90 | handle |
| 92 | bracket |
| 94 | bolt alignment attachment |
| 95 | bolt alignment attachment |
| 96 | screw |
| 97 | screw |
| 98 | blade |
| 99 | height indication mark |
| 100 | notch |
| 102 | notch |
| 104 | centerline |
| P | distance between centerline 104 and either keel 114 or locating pins 130 |
| 110 | curved front end |
| 112 | weld point |
| 114 | keel |
| 115 | curved rear end |
| 120 | third preferred embodiment of the finishing trowel according to the invention |
| 130 | locating pin |
| 140 | line of locating pins 130 |

-continued 600 fourth preferred embodiment of a finishing trowel according to the invention
605 blade
610 handle
620 arm
630 notch
640 bolt alignment attachment
700 fifth preferred embodiment of a finishing trowel according to the invention
701 keel
702 centerline
710 notch
712 notch
720 blade
730 groove
740 handle support
745 handle support
750 handle
760 height indicator mark
770 anchor bolt
K width of blade
V set distance of form to anchor bolt
T set height of anchor bolt
800 sixth preferred embodiment of a finishing trowel according to the invention
802 blade
810 side edge of blade
815 mark
817 mark
820 handle
830 side notch in blade
832 side notch in blade
835 rear notch in blade
840 vertical alignment attachment
843 notch in vertical alignment attachment
844 notch in vertical alignment attachment
845 fastening nut
850 handle support portion
860 side edge of blade
870 front edge of blade
872 front edge of blade
880 handle support
A angle between front edges of blade
D distance from edge of form to centerline of first common sill material
E set height of anchor bolt
F distance from edge of form to centerline of second common sill material
M diameter of notch indentations
900 seventh preferred embodiment of a finishing trowel according to the invention
902 block
903 handle
904 marker groove
905 screw
906 marker groove
907 groove for receiving anchor bolt
908 marker groove
909 post
910 marker groove
911 anchor bolt
913 hole for post
G distance between centerline of block and edge of block parallel to major axis of handle
H width of block
L distance from edge of form to centerline of first common sill material
N distance from edge of form to centerline of second common sill material
R set height of anchor bolt
920 seventh preferred embodiment of a finishing trowel according to the invention
922 block
923 handle
926 screw
927 anchor bolt hole
930 anchor bolt
932 marker groove
933 strap -continued 934 marker groove
935 screw
936 marker groove
938 marker groove
950 ninth preferred embodiment of a finishing trowel according to the invention
952 handle
954 bracket
956 screw
957 screw
958 bolt alignment attachment
960 side wing flange
962 side wing flange
964 roof flange
966 tab
967 alcove
969 hole for receiving anchor bolt
971 weld point
972 region of blade that is rounded downward
973 rounded corner
974 blade
976 anchor bolt

DETAILED DESCRIPTION OF THE PREFERRED EMBODIMENTS

Referring now to the drawings, a prior art finishing trowel 2 is shown in FIG. 1. It has a finishing surface in the form of a blade 1, a handle 3, and an arm 5 connecting the handle 3 with the blade 1. The blade 1 of the prior art finishing trowel is rectangular in shape and usually is made of steel. In order to finish around an anchor bolt the blade 1 of the prior art finishing trowel must be advanced to contact the anchor bolt and then either rotated around the anchor bolt or stroked on the other sides of the anchor bolt with separate movements.

Figure 2:
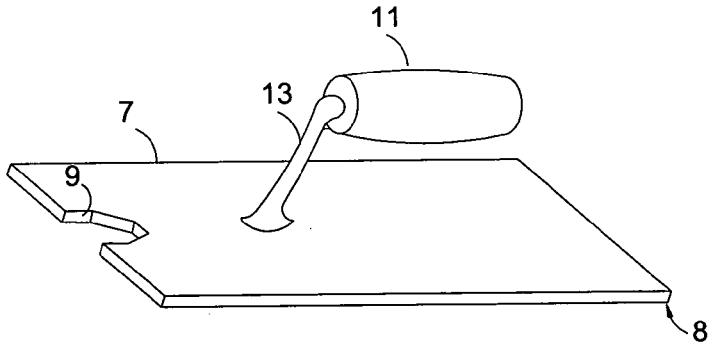
FIG. 2 is a perspective view from above of a first preferred embodiment of the finishing trowel according to the invention.

A first preferred embodiment of a finishing trowel according to the invention is shown in FIG. 2. This finishing trowel, designated by reference numeral 8, has a rectangular finishing surface in the form of a blade 7 connected by an arm 13 to a handle 11. The manner of connection of the arm 13 to the handle 11 and the blade 7 is accomplished by any of the means that are well known to the art to which this invention pertains. A notch 9 is formed in one of the sides of the blade 7 so that the notch 9 is aligned with the handle 11.

The notch 9 is large enough and so shaped as to be able to accommodate an anchor bolt. Anchor bolts used in the United Sates are typically one-half or five-eighths inch bolts. For ordinary use, therefore, the finishing trowel 8 should have a notch 9 wider than these sizes to accommodate the typical anchor bolt.

A workman will push or pull the trowel 8 towards an anchor bolt (not shown) embedded in wet concrete so as to engage that bolt in the notch 9. The blade 7 will then surround most of the bolt so as to finish the wet concrete around the bolt save for that portion of the bolt that faces the open end of the notch 9 when the bolt is engaged in the notch 9.

Figure 3:
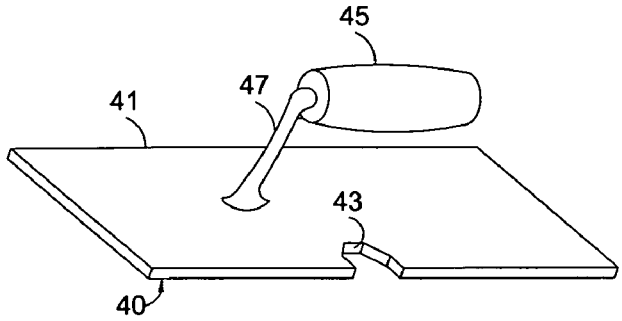
FIG. 3 is a perspective view from above of a variation of the first preferred embodiment of the finishing trowel according to the invention.

The first preferred embodiment of a finishing trowel according to the invention is shown in a variant form in FIG. 3. This finishing trowel, designated by reference numeral 40, has a rectangular blade 41 connected by an arm 47 to a handle 45. A notch 43 is formed in one of the long sides of the blade 41 so that the notch 43 is to the side of the handle 45. A workman can stroke the trowel 40 sideways towards an anchor bolt (not shown) embedded in wet concrete so as to engage that bolt in the notch 43. The blade 43 will then surround most of the bolt so as to finish the wet concrete around the bolt.

Figure 4A:
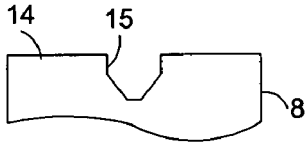
FIG. 4*a* is a top side view of a portion of the blade of the first preferred embodiment of the finishing trowel according to the invention showing the notch in the blade for engaging an anchor bolt.
Figure 4B:
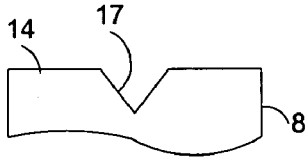
FIG. 4*b* is a top side view of a portion of the blade of the first preferred embodiment of the finishing trowel according to the invention showing an alternative shape for the notch for engaging an anchor bolt.
Figure 4C:
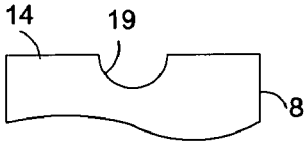
FIG. 4*c* is a top side view of a portion of the blade of the first preferred embodiment of the finishing trowel according to the invention showing an alternative shape for the notch for engaging an anchor bolt.
Figure 4D:
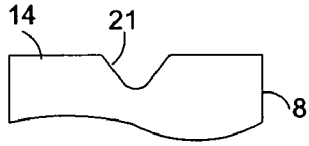
FIG. 4*d* is a top side view of a portion of the blade of the first preferred embodiment of the finishing trowel according to the invention showing an alternative shape for the notch for engaging an anchor bolt.
Figure 4E:
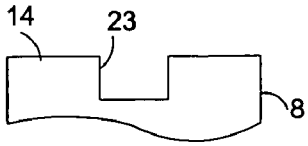
FIG. 4*e* is a top side view of a portion of the blade of the first preferred embodiment of the finishing trowel according to the invention showing an alternative shape for the notch for engaging an anchor bolt.
Figure 4F:
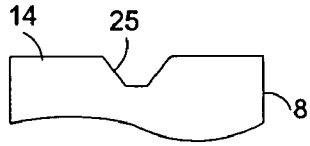
FIG. 4*f* is a top side view of a portion of the blade of the first preferred embodiment of the finishing trowel according to the invention showing an alternative shape for the notch for engaging an anchor bolt.
Figure 5:
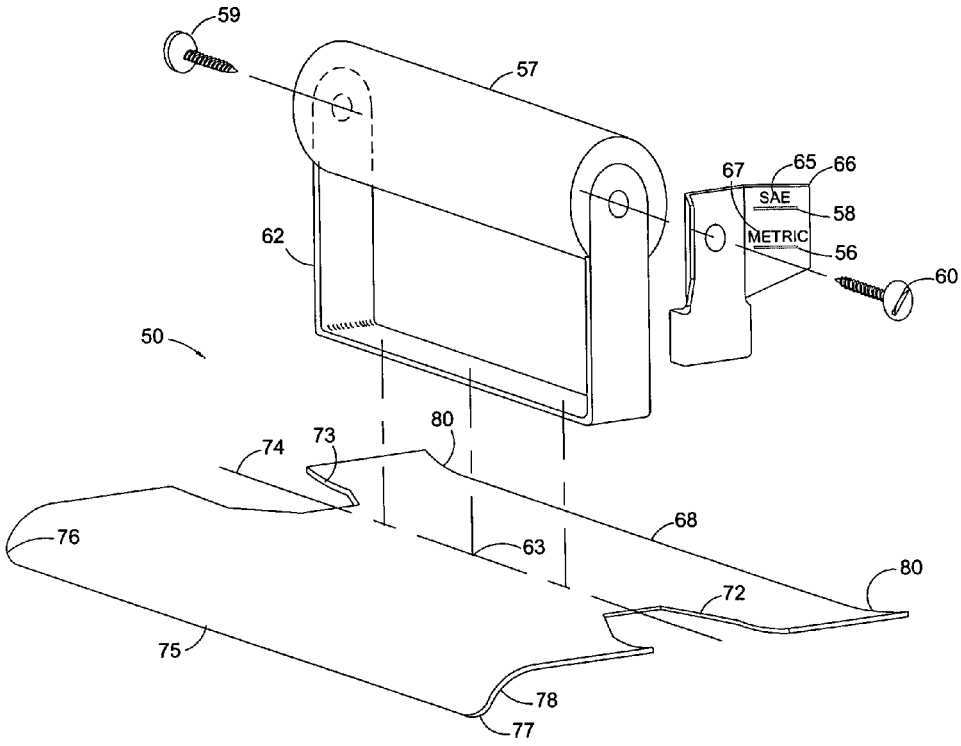
FIG. 5 is a perspective exploded view of a second preferred embodiment of a finishing trowel according to the invention.

FIG. 4*a* shows a portion of a blade 14 of an embodiment of a finishing trowel according to the invention with an exemplary notch 15 of preferred combination rectangular and angular shape. FIGS. 4*b*, 4*c*, 4*d*, 4*e*, and 4*f* show the blade 14 with notches 17, 19, 21, 23, and 25, respectively. These drawings show notches having variant shapes for accommodating an anchor bolt that are V-shaped, semi-circular, elliptical or parabolic, rectangular, and truncated angular, respectively FIGS. 5–8 show a second preferred embodiment of a finishing trowel according to the invention 50. A blade 68 is attached to a handle 57 by a U-shaped bracket 62 through weld points 63. The bracket 62 is connected to the handle 57 with flat-head screws 59 and 60. The screw 60 also secures a vertical bolt alignment attachment 66 to the handle 57. The bolt alignment attachment 66 is centered over a notch 72 in the blade 68.

A second notch 73 in the blade 68 is aligned to the notch 72 on an axis 74 centered below the bolt alignment attachment 66. The axis 74 is at a set distance Y (see FIGS. 7 and 8) from one edge 75 of the blade 68 to provide a means to space the centers of the notches 72 and 73 from the inside edge of concrete forms (not shown). The blade has a width that is preferably larger than the width between typical form boards for stem wall construction The edge 75 of the blade 68 has a curve downward (indicated by reference numeral 78) to provide a rounded edge to the finished concrete. The edges of the blade 68 in which notches 72 and 74 are indented have upward curves (indicated by reference numeral 82; see FIG. 6) for smoother finishing. In addition, the blade 68 is rounded at the corners 76 and 77 so that the blade 68 will not catch on the foundation form when the blade 68 is slid along the form.

In use, the finishing trowel 50 may be slid over the wet concrete along the edge of a form with edge 75 in contact with the form. The notches 72 and 74 permit the finishing trowel 50 to finish around the anchor bolts as explained in connection with the first preferred embodiment of the finishing trowel 8 and as shown in FIG. 6.

Figure 6:
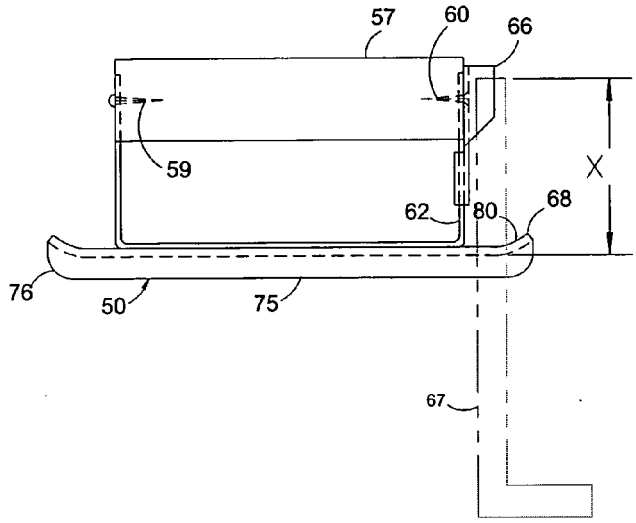
FIG. 6 is a front side view of the second embodiment of a finishing trowel according to the invention.

In FIG. 6 an anchor bolt 67 (shown in phantom) is contacting the blade 68 at the notch 72 so that the blade 68 envelops the anchor bolt 67.

In addition to finishing around the anchor bolts, the finishing trowel 50 can position them horizontally, align the bolts perpendicularly, and permit the workman to determine whether the anchor bolt is at the correct height above the wet concrete.

Figure 7:
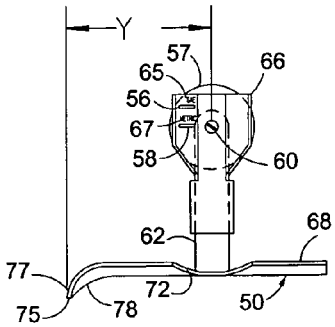
FIG. 7 is a left side view of the second embodiment of a finishing trowel according to the invention.
Figure 8:
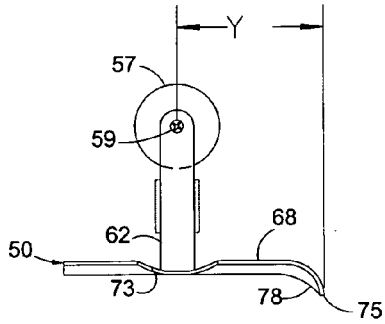
FIG. 8 is a right side view of the second embodiment of a finishing trowel according to the invention.

The finishing trowel 50 positions the anchor bolts horizontally because the notches 72 and 74 are at a set distance from the edge 75, thereby positioning the anchor bolts at a horizontal distance Y from the form (see FIGS. 7 and 8). For example, the horizontal distance Y will be 1.75 inches if the sill plate is to be a 2 by 4 (1.5 by 3.5 inches) stud and the anchor bolts are to be centered on the sill plate as is the usual practice.

The finishing trowel 50 aligns the anchor bolt perpendicularly because the notch 72 and the bolt alignment attachment 66 are aligned vertically and contact the anchor bolt at the level of the blade 68 and at the level of the handle 57 to confirm the perpendicular alignment of the anchor bolt when contacted. This is shown in FIG. 6 in which the anchor bolt 67 is so positioned.

The finishing trowel 50 permits the workman to determine whether the anchor bolt is at the correct height (shown as set anchor bolt height X in FIG. 6) above the wet concrete because the bolt alignment attachment 66 has height indication marks 56 and 58 thereon that the workman compares to the top of the anchor bolt when it is in contact with the bolt alignment attachment 66. The height indication marks 56 and 58 may bear indicia 65 and 67 to indicate the type of bolt (for example, "SAE" is the indicia 65) that is intended to be at the height of the height indication marks 56 and 58.

Figure 9:
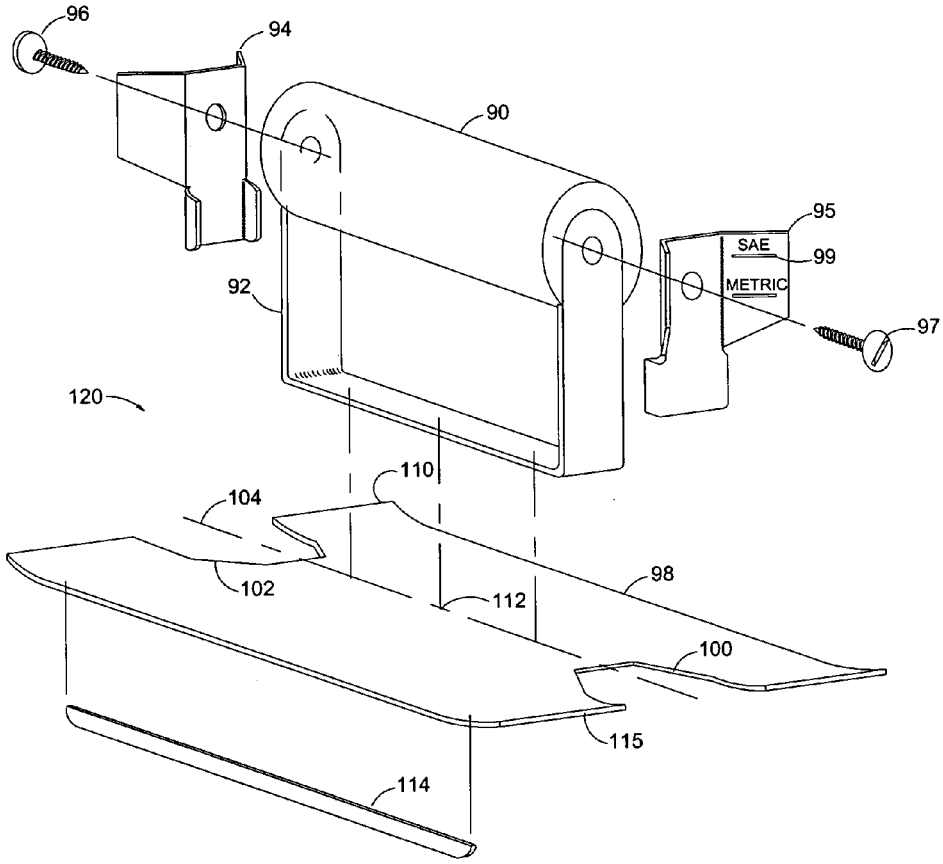
FIG. 9 is a perspective exploded view of a third preferred embodiment of a finishing trowel according to the invention.

FIG. 9 shows a third preferred embodiment of a finishing trowel according to the invention 120. This embodiment is similar to the embodiment shown in FIGS. 5–8 in that it has a blade 98 attached at weld points 112 to a bracket 92 that is connected by screws 96 and 97 to a handle 90. The blade 98 has opposing notches 100 and 102 formed therein that are aligned with the handle 90 and bracket 92.

The finishing trowel 120, however, has two bolt alignment attachments 94 and 95, rather than one, positioned over the notches 102 and 100, respectively. As a result, anchor bolts may be aligned perpendicularly and their heights corrected at two ends of the finishing trowel 120 as described in connection with the embodiment of the finishing trowel 50 shown in FIGS. 5–8. It will be noted that the finishing trowel 50 could also be provided with a second bolt alignment attachment so that it would have this capability.

The blade 98 has front and rear ends curved upward (indicated by reference numerals 115 and 110, respectively) for smoother finishing when the finishing trowel 120 is drawn along the axis 104. The width of the blade 98 is preferably larger than the width between typical form boards for stem wall construction.

This particular embodiment of the finishing trowel according to the invention 120 is unlike the embodiment of the finishing trowel 50 shown in FIGS. 5–8 in that the finishing trowel 120 does not have a curved down edge 75 for rounding the concrete at the contact with the form. Instead, the finishing trowel 120 has a keel 114 attached (by welding or the like process) to the blade 98 on its side opposite the handle 90. The keel 114 is a thin strip preferably made of metal such as a steel alloy for durability. The keel 114 is attached to the blade 98 parallel to and at a specified distance P (see FIG. 10) from the centerline 104 of the notches 100 and 102. The specified distance corresponds to the center of common framing sill material, as explained in connection with the distance Y of the finishing trowel 50 shown in FIGS. 5–8. The keel 114 is intended to run between the concrete and the form so that the notches 100 and 102 contact the anchor bolts at the correct distance from the form for positioning them horizontally.

Figure 10:
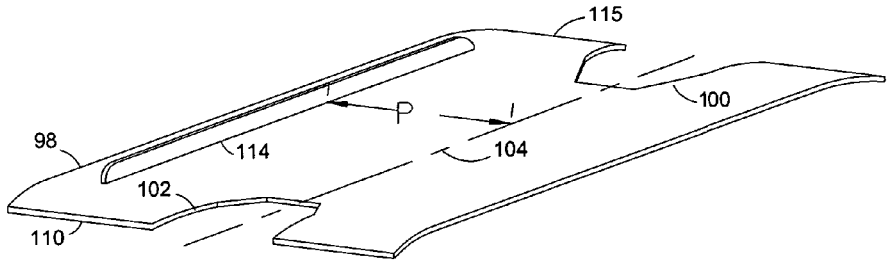
FIG. 10 is a perspective view from below of the blade of the third preferred embodiment of a finishing trowel according to the invention.

FIG. 10 shows the bottom of the blade 98 of the finishing trowel 120 shown in FIG. 9. The keel 114 is attached parallel to and at the fixed distance P relative to the centerline 104 of the notches 100 and 102. The blade 98 curves at front 115 and rear 110.

Figure 11:
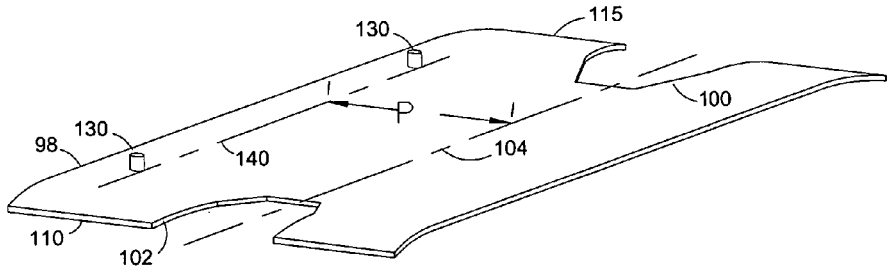
FIG. 11 is a perspective view from below of a variation of the blade of the third preferred embodiment of a finishing trowel according to the invention.

FIG. 11 shows the bottom of the blade 98 of the finishing trowel 120 shown in FIGS. 9 and 10 but with a variant means used to position the blade 98 with respect to the form. Two locating pins 130 stationed along the line 140 parallel to and spaced from the centerline 104 by the fixed distance P perform the function of the keel 114 shown in FIGS. 9 and 10.

Figure 12:
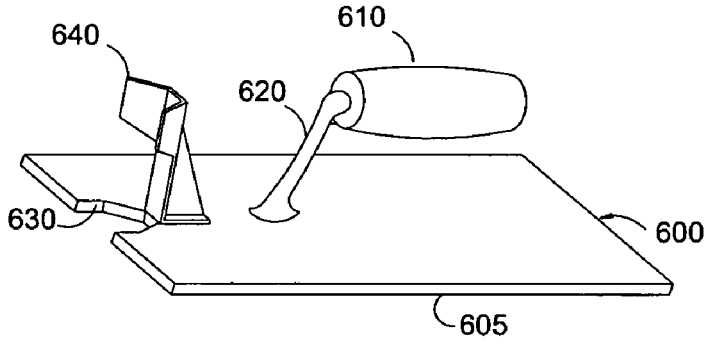
FIG. 12 is a perspective view from above of a fourth preferred embodiment of a finishing trowel according to the invention.

FIG. 12 shows a fourth preferred embodiment of a finishing trowel according to the invention 600. A blade 605 is attached by an arm 620 to a handle 610. The blade has a notch 630 formed therein to receive an anchor bolt. A bolt alignment attachment 640 is attached directly to the top of the blade 605 and adjacent to and above the notch 630. The connection of the bolt alignment attachment 640 directly to the blade 605 rather than to the handle 610 distinguishes this embodiment from those shown in FIGS. 5–9. The bolt alignment attachment 640, in conjunction with the notch 630 formed in the blade 605, performs the functions described in connection with the bolt alignment attachment 66 of the finishing trowel 50 shown in FIGS. 5–8.

Figure 13:
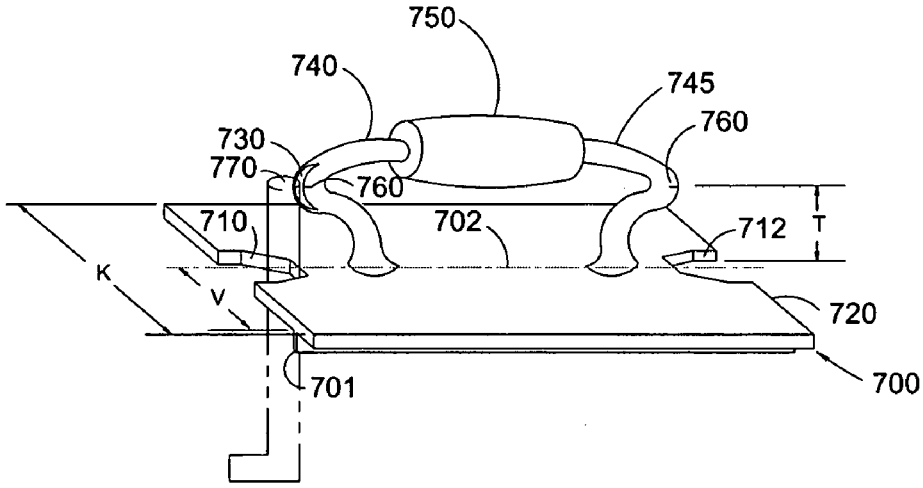
FIG. 13 is a perspective view from above of a fifth preferred embodiment of a finishing trowel according to the invention.

FIG. 13 shows a fifth preferred embodiment of a finishing trowel according to the invention 700. A blade 720 has a width "K" being larger than the distance between typical stem wall footing form boards. A keel 701 is fixed to the bottom of the blade at a set distance "V" from the keel to the centerline 702 running between the notches 710 and 712 formed in the blade 720. The distance "V" corresponds to the distance between the edge and the center of common sill material so that anchor bolts can be positioned to be on the centerline of the sill that will be supported by the foundation.

The blade 720 is attached to a handle 750 by handle supports 740 and 745. The handle supports 740 and 760 have grooves 730 (only one groove 730 is visible in FIG. 13) aligned on the centerline 702 running between the notches 710 and 712 in the blade 720. The handle support grooves 730 are located directly above the notches 710 and 712, with a height indicator mark 760 integral to each of the handle supports 740 and 745 and adjacent to each handle support notch 730. The height indicator mark 760 set at a distance "T" corresponding to the height of the bolt required for common sill construction. An anchor bolt 770 is shown in phantom to illustrate how the handle support notches 730 in combination with the grove 730 and height indicator mark 760 vertically align and confirm the vertical height of the anchor bolt.

Figure 14:
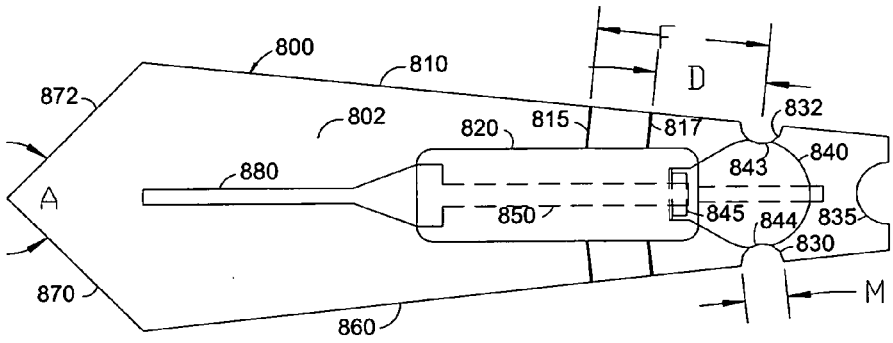
FIG. 14 is a top side view of a sixth preferred embodiment of a finishing trowel according to the invention.
Figure 15:
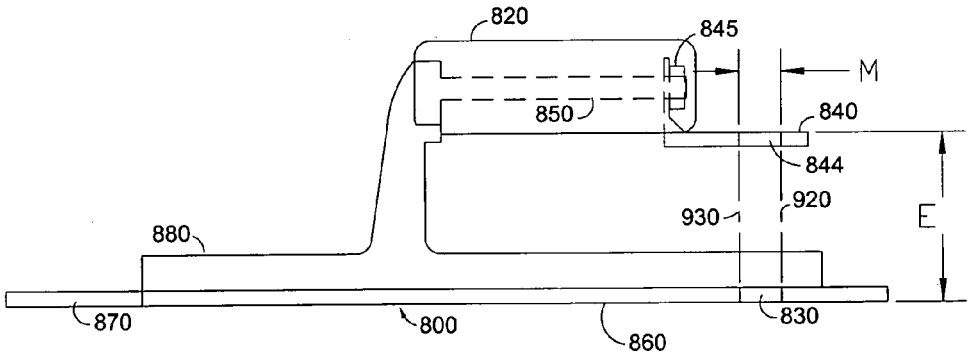
FIG. 15 is a front side view of the sixth preferred embodiment of a finishing trowel according to the invention.

FIGS. 14 and 15 show top and side views of a sixth preferred embodiment of a finishing trowel according to the invention 800. The finishing trowel 800 has a blade 802 for a finishing surface that has side edges 810 and 860. The blade 802 has front edges 870 and 872 forming an angle "A." Angle "A" preferably is any angle equal to or less than ninety degrees.

The blade 802 has side notches 830 and 832 in the edges 860 and 810 of the blade 802, respectively. On the top of the blade 802 are stamped or otherwise imprinted marks 815 and 817 at distances of "F" and "D" from the centerlines of the corresponding side notches 830 and 832. These distances are the distances from the edge to the centerline of common sill material.

The openings of the side notches 830 and 832 have a diameter "M" larger than common anchor bolt diameters. An additional notch 835 is formed in the rear edge of the blade 802. The notch 835 is of larger diameter than the side notches 830 and 832 to accommodate larger than typical anchor bolts or reinforcing bars.

The blade 802 is attached to a handle 820 by means of a handle support 880 that terminates in a portion 850 that extends through the handle 820 and is threaded at one end to allow a fastening nut 845 to secure the handle 820 to the portion 850 of the handle support 880. The fastening nut 845 also fixes a vertical alignment attachment 840 to the portion 850 and the handle 820. The vertical alignment attachment 840 has two notches 843 and 844 located directly above the side notches 832 and 830 in the blade 802, respectively. The openings that form notches 843 and 844 have the same diameter as the side notches 830 and 832 so that a vertically oriented anchor bolt will fit against both the upper notches 843 or 844 and the lower notches 832 or 830, respectively. The vertical alignment attachment 840 is located at distance "E" from the bottom of the blade 802 corresponding to the required height of anchor bolts for common construction practice.

The two sets of vertically aligned notches permit the workman to align perpendicularly and confirm the height of an anchor bolt while finishing around that anchor bolt, as described in connection with the discussion of the second preferred embodiment of the finishing trowel shown in FIGS. 5–8. The workman can also position the anchor bolt horizontally with respect to the form using marks 815 and 817 on the blade 802.

Figure 16:
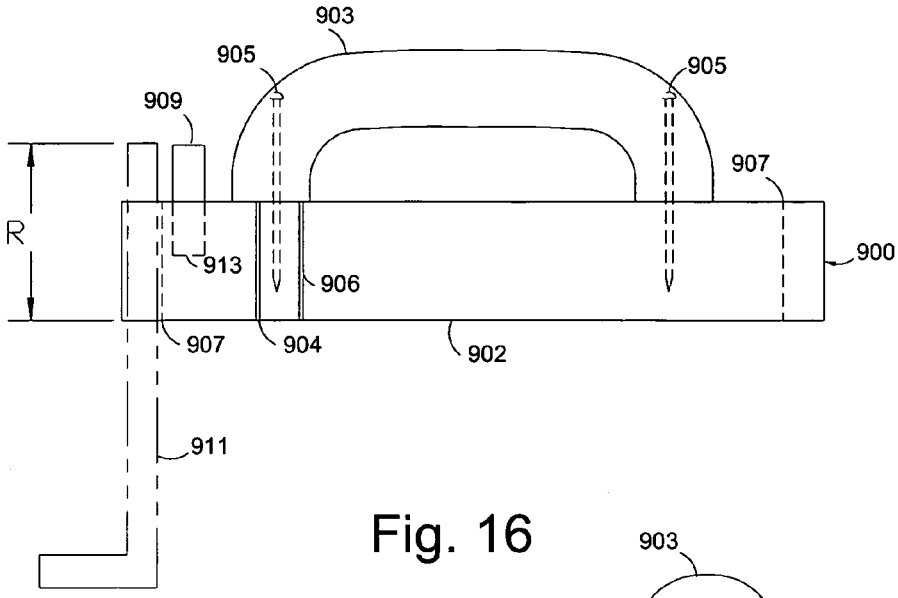
FIG. 16 is a front side view of a seventh preferred embodiment of a finishing trowel according to the invention.
Figure 17:
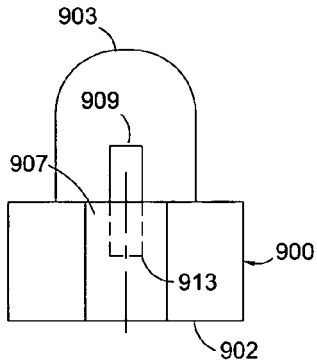
FIG. 17 is a left side view of the blade of the seventh preferred embodiment of a finishing trowel according to the invention.
Figure 18:
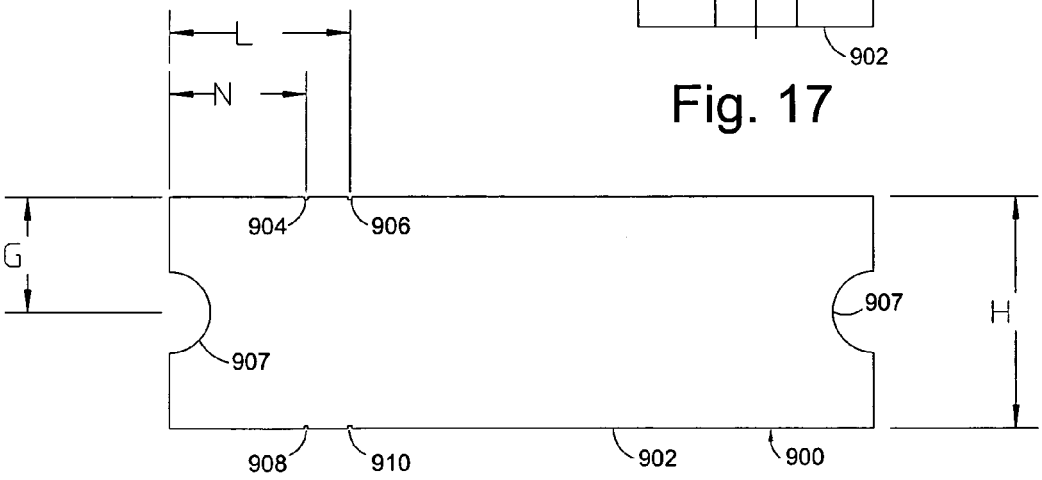
FIG. 18 is a bottom side view of the seventh preferred embodiment of a finishing trowel according to the invention.

FIGS. 16–18 show views of a seventh preferred embodiment of a finishing trowel according to the invention 900. This embodiment of the finishing trowel according to the invention may be made of wood. As shown in FIG. 16, a block 902 serves as a finishing surface and may be cut from a board or stud such as a two by six stud. The block 902 has a width "H" larger than the distance between typical stem wall footing form boards.

A handle 903 is attached to the top of the block 902 by screws 905. It will be understood by those of skill in the art that the handle 903 could be attached to the block 902 by screws, glue, dovetailing, or other means. Two grooves 907 are milled into or otherwise formed in the ends of the block 902 along the centerline of the block that is parallel to the handle 903. These grooves 907 are sized to receive and accommodate anchor bolts. The distance "G" between the centerline of the block 902 parallel to the major axis of the handle 903, and in this case the distance between the centers of the grooves 907 and the sides of the block 902, will be larger than the distance from edge to centerline of common sill material because the block 902 has a width "H" larger than the distance between typical stem wall footing form boards.

A post 909 is inserted into a hole 913 drilled into the top of the block 902 adjacent to one of the notches 907. The shape of the post is not important as much as its height. The post 909 is sized so that its top reaches a total distance "R" above the bottom of the block 902 corresponding to the required height of the bolt for common construction practice. As shown in FIG. 16, the height of an anchor bolt 911 (shown in phantom) may be compared to the top of the post 909 while finishing around the anchor bolt. Also while finishing the anchor bolt will be aligned vertically by contacting the block 902 at the groove 907. The block 902 is thicker than the blades of embodiments described earlier so an upper alignment attachment is not required.

Marker grooves 904, 906, 908, and 910 are milled or cut into the sides of the block 902 that do not contain the grooves 907. The workman can position the anchor bolts horizontally using these marker grooves 904, 906, 908, and 910 by rotating the block 902 to be perpendicular to the form boards and aligning either the set of the marker grooves 904 and 908 or the set of marker grooves 906 and 910 with the inner edge of the form board (not shown).

Figure 19:
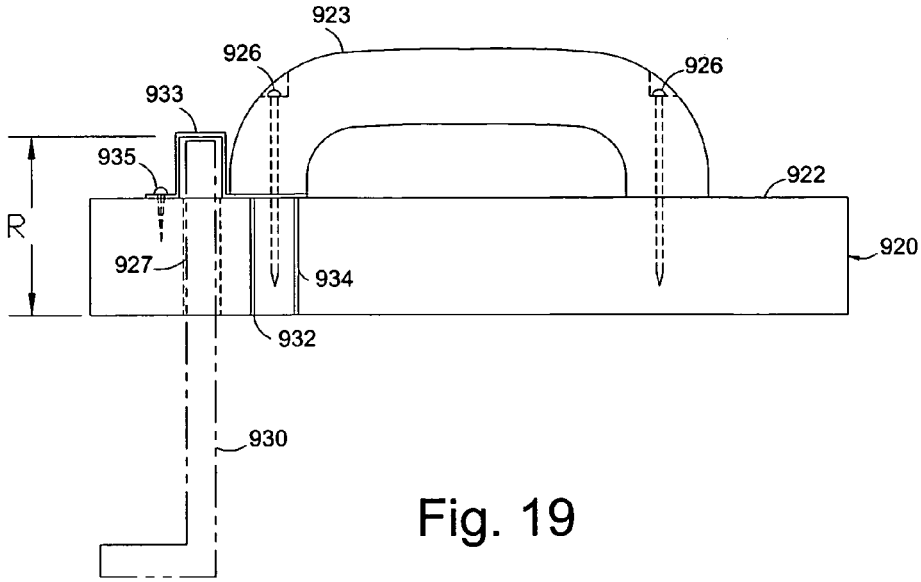
FIG. 19 is a front side view of an eighth preferred embodiment of a finishing trowel according to the invention.
Figure 20:
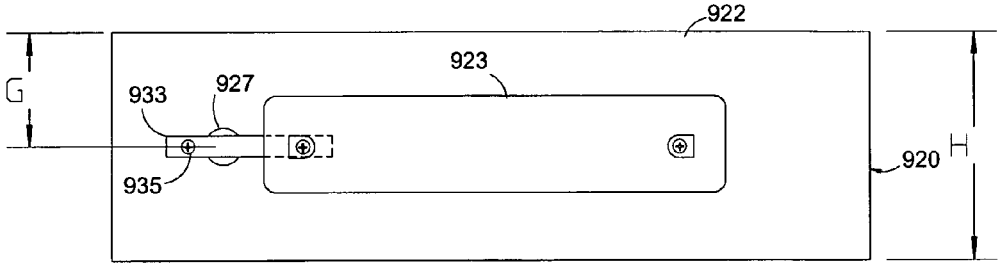
FIG. 20 is a top side view of the eighth preferred embodiment of a finishing trowel according to the invention.
Figure 21:
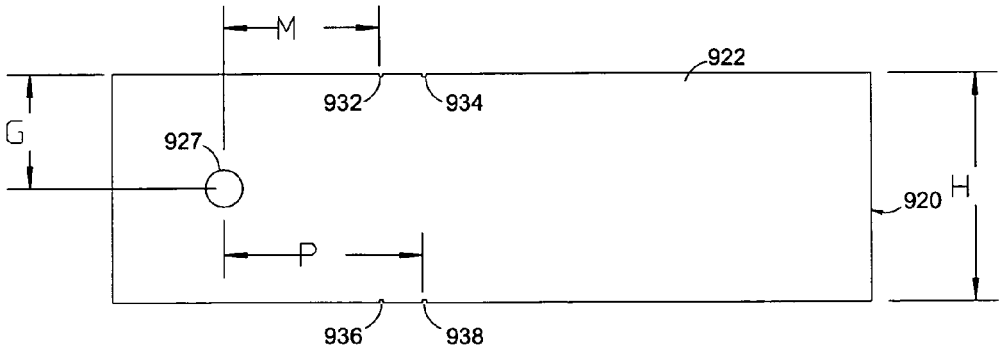
FIG. 21 is a bottom side view of the eighth preferred embodiment of a finishing trowel according to the invention.

FIGS. 19–21 show views of an eighth preferred embodiment of a finishing trowel according to the invention 920. This embodiment of the finishing trowel according to the invention also may be made of wood. As shown in FIG. 19, a block 922 serves as a finishing surface and may be cut from a board or stud such as a two by six stud. The block 922 has a width "H" larger than the distance between typical stem wall footing form boards, as in the embodiment shown in FIGS. 16–18.

A handle 923 is attached to the top of the block 922 by two screws 926. It will be understood by those of skill in the art that the handle 923 could be attached to the block 922 by screws, glue, dovetailing, or other means.

A vertically oriented hole 927 is drilled through the block 922. This hole 927 has a diameter larger than the diameter of the upper end of an anchor bolt so that the upper end of the anchor bolt can slide into and out of the hole 927 but without twisting. The distance "G" between the centerline of the block 922 parallel to the major axis of the handle 923, and in this case the distance between the centers of the hole 927 and the sides of the block 922, will be larger than the distance from edge to centerline of common sill material because the block 922 has a width "H" larger than the distance between typical stem wall footing form boards.

The top of the hole 927 is surmounted by a metal strap 933. One end of the strap 933 is attached to the top of the block 922 by a screw 935 and at the other end by being pinned between the handle 923 and the top side of the block 922. The strap 933 is bent by four right angle turns so that it projects above the hole 927 to allow the top of the anchor bolt 930 (shown in phantom) to reach the predetermined height "R" above the bottom of the block 922 when the anchor bolt is inserted into the hole 927 formed in the block 922.

In this embodiment of the invention the hole 927 takes the place of a notch in the edge of a blade or block but the embodiment will accomplish the operations of finishing around the anchor bolt, vertical alignment of the bolt, and adjustment of the height of the bolt. The finishing trowel 920 is simply rotated slightly after it is laid on the anchor bolt so that the anchor bolt enters the hole 927.

Marker grooves 932, 934, 936, and 938 are milled or cut into the sides of the block 922 that are parallel to the major axis of the handle 923. The workman can position the anchor bolts horizontally using these marker grooves 932, 934, 936, and 938 by rotating the block 922 to be perpendicular to the form boards and aligning either the set of the marker grooves 932 and 9936 or the set of marker grooves 934 and 938 with the inner edge of the form board (not shown).

Figure 22:
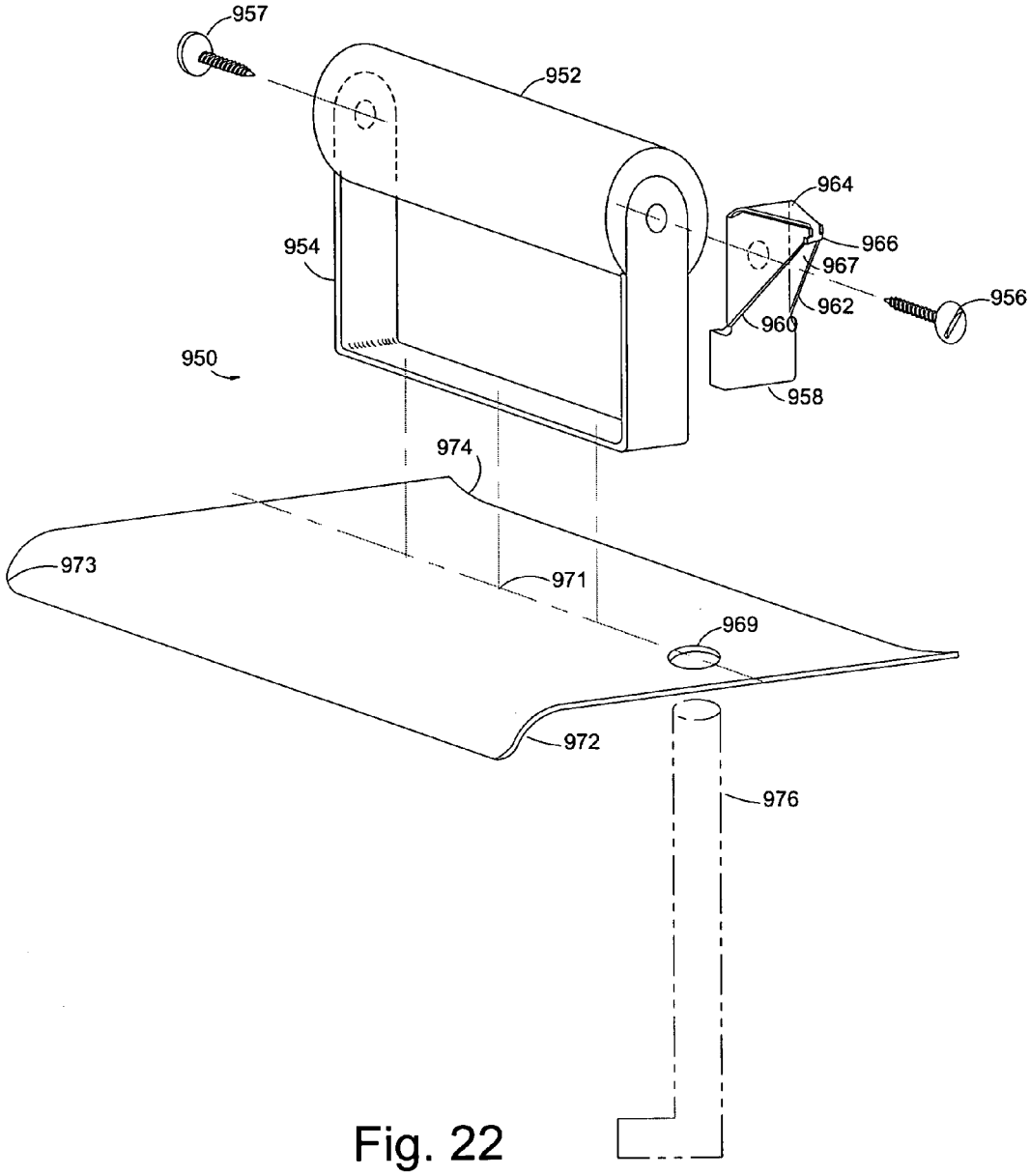
FIG. 22 is a perspective view from above of a ninth preferred embodiment of a finishing trowel according to the invention.

FIG. 22 shows a ninth preferred embodiment of a finishing trowel according to the invention 950. This embodiment is similar to the embodiment shown in FIGS. 5–8 in that it has a blade 974 attached at weld points 971 to a bracket 954 that is connected by screws 956 and 957 to a handle 952.

The blade 974 has a hole 969 formed therein that is aligned with the handle 952 and bracket 954. The hole 969 is sized to accommodate an anchor bolt 976 so that the anchor bolt 976 can be inserted through the hole 969 in the blade 974 in order to allow the finishing trowel 950 to finish the plastic or wet concrete around the anchor bolt 976 when the finishing trowel 950 is pressed down around the anchor bolt 976 against the wet or pliable concrete.

A bolt alignment attachment 958, for aligning the anchor bolt 976 vertically as well as setting its height; is attached by the screw 956 to the bracket 954. The bolt alignment attachment 958 has formed in it side wing flanges 960 and 962 as well as a roof flange 964. The side wing flanges 960 and 962 and the roof flange 964 are bent toward each other and joined by a tab 966 formed in the roof flange 964 to form an alcove 967 that is open at its bottom to receive the anchor bolt 976 when the anchor bolt 976 is inserted through the hole 969 in the blade 974. The bolt alignment attachment 958 is positioned so as to vertically align and set the height of the anchor bolt 976 when the upper end of the anchor bolt 976 is located in the alcove 967 and in contact with the roof flange 964.

While the invention has been described in conjunction with the preferred embodiments, it will be understood that it is not intended to limit the invention to these embodiments. On the contrary, the invention is intended to cover alternatives, modifications and equivalents that may be included within the spirit and scope of the invention as defined by the appended claims.

What is claimed is:

1. A trowel for finishing a plastic material around a bolt embedded in and protruding from the plastic material, comprising:

a finishing surface with a top side and a bottom side and a plurality of edges including a first edge, a handle attached to and positioned above the top side of the finishing surface, and the finishing surface having an opening formed therein that is sized and shaped to receive the bolt so that the bottom side of the finishing surface can be used to finish the plastic material around the bolt; and bolt aligning and bolt height indicating means attached to the top side of the finishing surface.

2. The trowel according to claim 1 in which the opening is a notch formed in the finishing surface at the first edge of the finishing surface, the notch being sized and shaped to receive the bolt when the first edge of the finishing surface is advanced toward the bolt.

3. The trowel according to claim 1 in which the opening is a vertically aligned hole formed in the bottom side of the finishing surface and sized and shaped to receive the bolt when the finishing surface is placed over the bolt.

4. The trowel according to claim 1 further comprising means associated with the finishing surface for setting a predetermined distance between a form containing the plastic material and the opening in order to horizontally position the bolt.

5. The trowel according to claim 1 further comprising means associated with the finishing surface for indicating a predetermined distance between a form containing the plastic material and the opening in order to horizontally position the bolt.

6. The trowel according to claim 1 in which the bolt aligning and bolt height indicating means are attached to the handle.

7. The trowel according to claim 1 in which the blade is curved downwardly at an edge other than the first edge in order to produce a rounded edge to a side of a wall of the plastic material when the blade is moved along a top surface of the plastic material.

8. The trowel according to claim 1 in which the blade is curved upwardly at the first edge so that the blade can be advanced along a top surface of the plastic material with the first edge in front and above the top surface of the plastic material.

9. The trowel according to claim 1 further comprising means attached to and protruding from the bottom side of the blade for contacting a form for containing the plastic material when the blade is moved along a top surface of the plastic material in order to horizontally position the bolt when the bolt is received in the notch.

10. A trowel for finishing a plastic material around an anchor bolt embedded in and protruding from the plastic material, comprising:

a block with a top side and a bottom side and a plurality of edges including a first edge, a handle attached to and positioned above the top side of the block, and an opening formed in the block that is sized and shaped to receive the bolt so that the block can be used to finish around the bolt;

wherein the block has sufficient thickness that the opening has a height sufficient to vertically align the bolt when the block is in contact with the bolt at the opening.

11. The trowel according to claim 10 in which the opening is a notch formed in the block at the first edge that is sized and shaped to receive the bolt when the first edge of the block is advanced toward the bolt.

12. The trowel according to claim 10 in which the opening is a vertically aligned hole formed in the bottom side of the block, the hole being sized and shaped to receive the bolt.

13. The trowel according to claim 12 in which the hole communicates between the top and the bottom sides of the block and further comprising means attached to the top side of the block for use in adjusting to a pre-determined amount the height to which the bolt protrudes above the plastic material.

* * * * *